US005494195A

United States Patent [19]

Knuettel, II et al.

[11] Patent Number: 5,494,195

[45] Date of Patent: Feb. 27, 1996

[54] MACHINE FOR DISPENSING CHILLED BEVERAGE USING THERMOELECTRIC COOLING SYSTEM

[76] Inventors: Francis P. Knuettel, II, 23 Brookridge Rd., New Rochelle, N.Y. 10804; Mohamad K. Moallemi, 69-07 226th St., Bayside, N.Y. 11364

[21] Appl. No.: 293,759

[22] Filed: Aug. 22, 1994

[51] Int. Cl.[6] ..... B67D 5/62

[52] U.S. Cl. ..... 222/146.6; 222/132; 62/3.64; 312/236

[58] Field of Search ..... 222/132, 145.5, 222/146.6, 325, 183; 62/3.6, 3.64; 312/236

[56] References Cited

U.S. PATENT DOCUMENTS 3,930,598 1/1976 Slagle ..... 222/132 X
4,757,920 7/1988 Harootian, Jr. et al. ..... 222/183 X
4,913,318 4/1990 Forrester ..... 222/146.6
4,913,713 4/1990 Bender et al. ..... 62/3.64 X
5,209,069 5/1993 Newman ..... 62/3.64

*Primary Examiner*—Gregory L. Huson
*Attorney, Agent, or Firm*—Morgan & Finnegan

[57] ABSTRACT

A machine dispenses chilled alcoholic beverage using a thermoelectric cooling unit positioned within a machine enclosure formed by a housing having side and top walls. A manifold receives beverage, which flows through a cooling channel extending from the manifold to a beverage faucet positioned on the outer surface of the housing. The cooling channel has walls defining the channel. A thermoelectric cooling device extends along a portion of the channel walls and has a cold junction surface proximal to the beverage which cools the beverage in conjunction with a hot junction surface spaced from the cold junction surface and distal to the beverage. A heat sink extends from the hot junction surface for dissipating heat from the hot junction surface.

21 Claims, 8 Drawing Sheets

MACHINE FOR DISPENSING CHILLED BEVERAGE USING THERMOELECTRIC COOLING SYSTEM

FIELD OF THE INVENTION

This invention relates to a machine for dispensing chilled beverage, and more particularly to a machine for dispensing chilled beverage which includes a thermoelectric cooling unit.

BACKGROUND OF THE INVENTION

In most cooling systems for beverages, and particularly for alcoholic beverages, conventional vapor-compression systems include fundamental components such as an evaporator, a compressor and condenser. The evaporator, or cold section, allows a pressurized refrigerant to expand, boil and evaporate. During this change of state from liquid to gas, energy (heat) is absorbed. The compressor acts as a refrigerant pump and recompresses the gas to a liquid. The condenser expels the heat absorbed by the evaporator and produced during compression into the ambient environment.

These conventional vapor-compression refrigerant systems are adequate for large cooling needs. However, it is desirable to dispense some beverages such as specialty beverages, or liqueurs, that are more viscous than most beer and wines and have higher alcohol contents, i.e., about thirty-five percent, from artistically designed bottles placed on compact, artistically designed dispensing machines which are readily visible to the public. The bottles are inverted, or inclined, and mounted on the machine. The beverage is withdrawn from the bottles into the refrigerant unit mounted inside the machine. The machines are typically table-top units or placed on bars and readily visible to the public.

The use of conventional refrigeration systems is sometimes costly for use in small units such as table top machines located at bars. These units have a small size capacity, e.g. only a few bottles, but also require a compressor, refrigerator coil, condenser, pump, fan, and other associated refrigeration equipment which must be placed in a small compact housing. This adds to the cost of the overall unit and its daily operating cost.

It is therefore an object of the present invention to have a more efficient, yet cost effective system for cooling beverage without using a conventional vapor-compression refrigeration system.

It is another object of the present invention to have a machine for dispensing chilled beverage which has precise temperature control, high reliability, low weight and cost and minimal space as compared to more conventional vapor-compression refrigeration units.

SUMMARY OF THE INVENTION

The present invention provides advantageous features and advantages over prior art machines for dispensing chilled beverages such as alcoholic beverages which use conventional vapor-compression refrigeration systems. The machine of the present invention dispenses chilled alcoholic beverages and provides adequate cooling to the beverage while using a thermoelectric cooling means that is limited in space, provides precise temperature control, has high reliability with low cost, and is low in weight.

The machine in accordance with the present invention has a housing forming an enclosure and an outer surface. Beverage is received in a manifold within the housing. A beverage faucet is mounted on the outer surface of the housing. A cooling channel extends from the manifold to the beverage faucet. The cooling channel has walls defining the channel. A thermoelectric cooling system extends along a portion of the channel walls and has a cold junction surface proximal to the beverage which cools the beverage and a hot junction surface spaced from cold junction surface and distal to the beverage. A heat sink extends from the hot junction for dissipating heat from the hot junction.

In one aspect of the invention the heat sink is formed from cooling fins connected to the hot junction surface. A fan blows air over the heat sink for cooling the fins and dissipating heat from the hot junction. Insulation covers at least a portion of the channel walls to maintain the beverage at a chilled temperature. In a preferred aspect of the invention, the insulation covers all the walls except where the thermoelectric modules are positioned. In one aspect of the invention the cooling channel walls extend between front and rear plates and form a cooling unit that may be removed from the housing. In another aspect of the invention, the channel contains spherical balls which store cold temperature and conduct heat away from the beverage. The channel walls can a rectangular structure, and the thermoelectric cooling system may be formed from a plurality of thermoelectric modules forming a part of the channel walls. The thermoelectric cooling system preferably has semiconductor modules forming a thermocouple with hot and cold junctions.

In another aspect of the invention as shown in the drawings, the housing forms an enclosure having side and top surfaces which are dimensioned to form a housing of a size to be placed on the countertop of bar. At least one bottle mount extends from the manifold upward through the housing and is configured for receiving a stopper shaft inserted within a beverage container so that the beverage container may be invertibly mounted on the housing to supply beverage to the cooling tank.

An air valve and check valve are operatively connected to the manifold for permitting air flow therethrough. The air valve is removably mounted on the housing to facilitate removal and cleaning of the valve.

BRIEF DESCRIPTION OF THE DRAWINGS

The advantages of the present invention will be appreciated more fully from the following description, with references to the accompanying drawings in which.

DETAILED DESCRIPTION OF THE INVENTION

Figure 1:
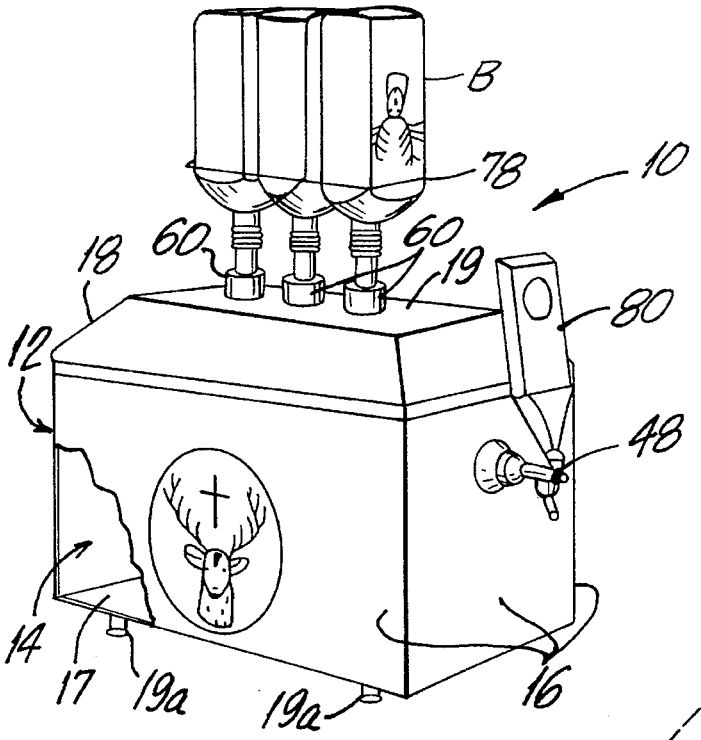
FIG. 1 is an environmental view of the machine of the present invention which dispels chilled alcoholic beverage using a thermoelectric cooling system.

Referring now to FIG. 1, there is illustrated at 10 an environmental view of the machine for dispensing chilled alcoholic beverages in accordance with the present invention. The machine 10 includes a generally rectangular configured housing, indicated generally at 12, that forms an enclosure, indicated generally at 14, and has an outer surface with side walls 16, a bottom surface 17 and a top surface 18, which has upwardly inclined walls converging to a flat top 19. The side 16, bottom 17, and top 18 surfaces are of a preferred dimension so that the machine may be placed on the countertop of a bar (not shown), table or other similar structure. Leg supports 19A can be secured on the bottom surface.

Figure 2:
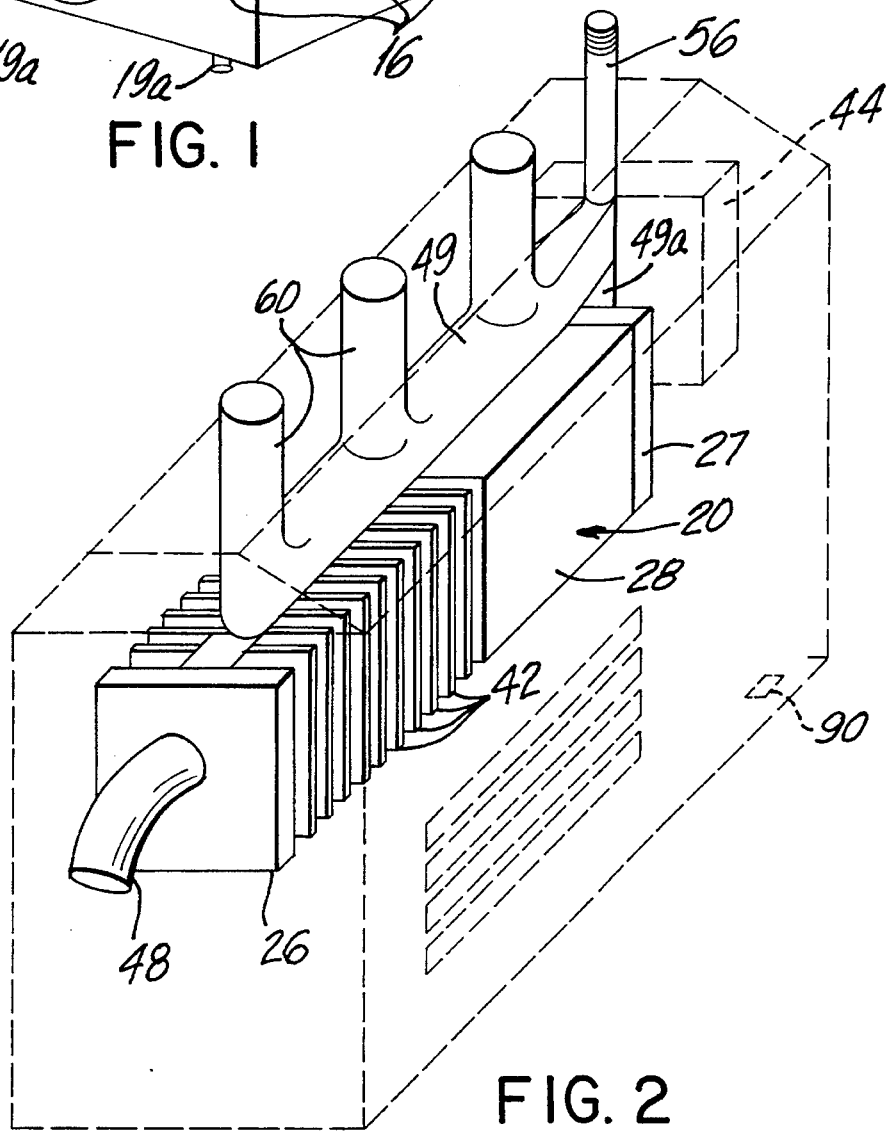
FIG. 2 is a schematic view of the thermoelectric cooling device of the present invention showing the manifold extending along a top portion of the housing.
Figure 4:
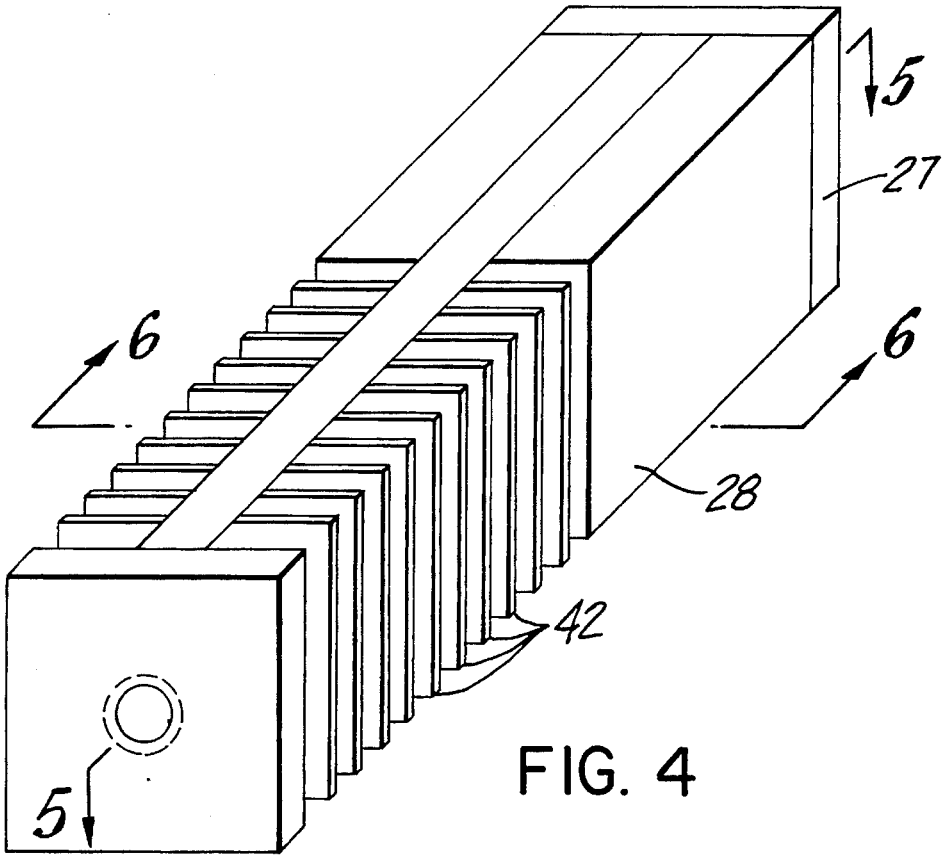
FIG. 4 is a schematic, isometric view of the thermoelectric cooling unit of the present invention.
Figure 5:
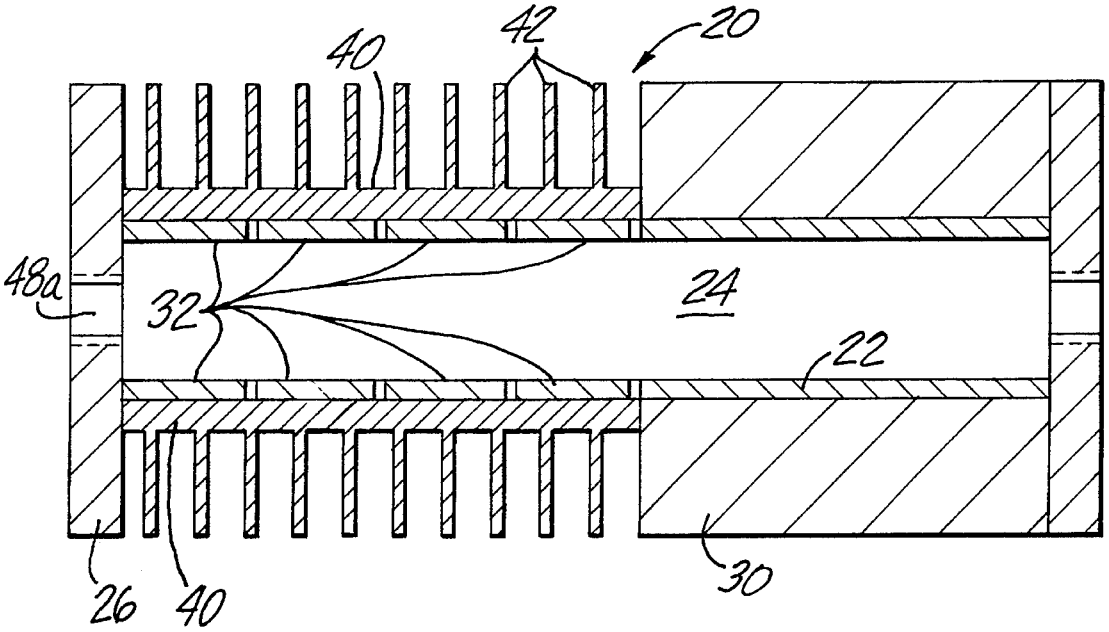
FIG. 5 is a sectional view taken along line 5—5 of FIG. 4.

As shown in the schematic illustration at FIG. 2, the machine 10 includes a thermoelectric cooling unit, indicated generally at 20, contained within the housing 12. The unit 20 is a complete assembly which can be easily removed from the housing as a single unit for maintenance or replacement. The thermoelectric cooling unit 20 includes side walls 22 forming a channel 24 through which beverage is received and exits (FIGS. 4 and 5). In the illustrated embodiment, the side walls 22 are substantially rectangular configured, and respective front and rear mounting plates 26, 27 hold the unit together so that the unit can be removed as one piece from the housing 12. The mounting plates 26, 27 and wall 22 can be formed from stainless steel, molded plastic, or other similar material.

As illustrated in FIG. 5, a substantial portion of the side wall is covered by a rectangular configured insulator 30 to maintain the beverage in a chilled state while held within the cooling channel. The insulation 30 extends completely around the side walls 22 forming the cooling channel along the rear portion thereof. The insulator 30 can be formed from closed cell foam, or other insulating material. As shown in FIG. 4, the insulation 30 is dimensioned to form a substantially rectangular configured unit.

A plurality of thermoelectric modules 32, form a part of the side wall 22 along the front portion of the unit. Each thermoelectrical module 32 is formed of a thermoelectric thermocouple made from two elements of semi-conductor material such as a Bismuth Telluride which is heavily doped to create an excess (n-type) or deficiency (p-type) of electrons. Heat is absorbed at a cold junction surface, indicated at 34 and pumped to the hot junction surface, indicated at 35, at a rate proportional to the current passing through the circuit and the number of couples (FIG. 12). As shown in FIG. 12, a n-type and p-type semiconductor are connected between electrical conductors 36 and electrical insulators 37. Current passes through by source 38, cooling the load 39. A heat sink 39*a* withdraws heat.

Figure 12A:
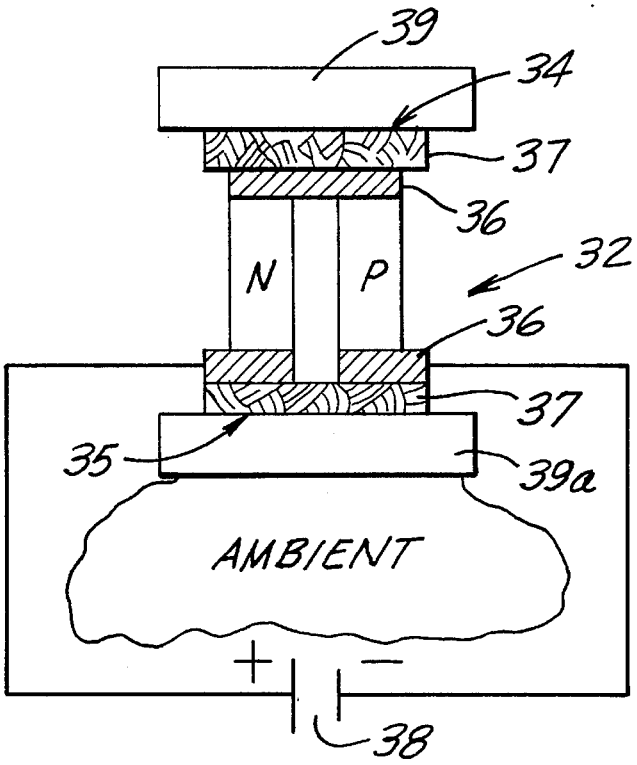
FIG. 12*a* is a schematic view of a thermoelectric module showing cold and hot junction surfaces.

These thermocouples are combined into the module 32 where they can be connected electrically in series and thermally in parallel (FIG. 12*a*). A typical module 32 that can be used with the present invention measures about one inch by one inch by three-sixteenth thick. Examples of such modules 32 which can be used with the present invention include those manufactured by Melcor, Materials Electronic Products Corporation, of Trenton, N.J. and sold under the designation CP1 4-127-0450.

Figure 6:
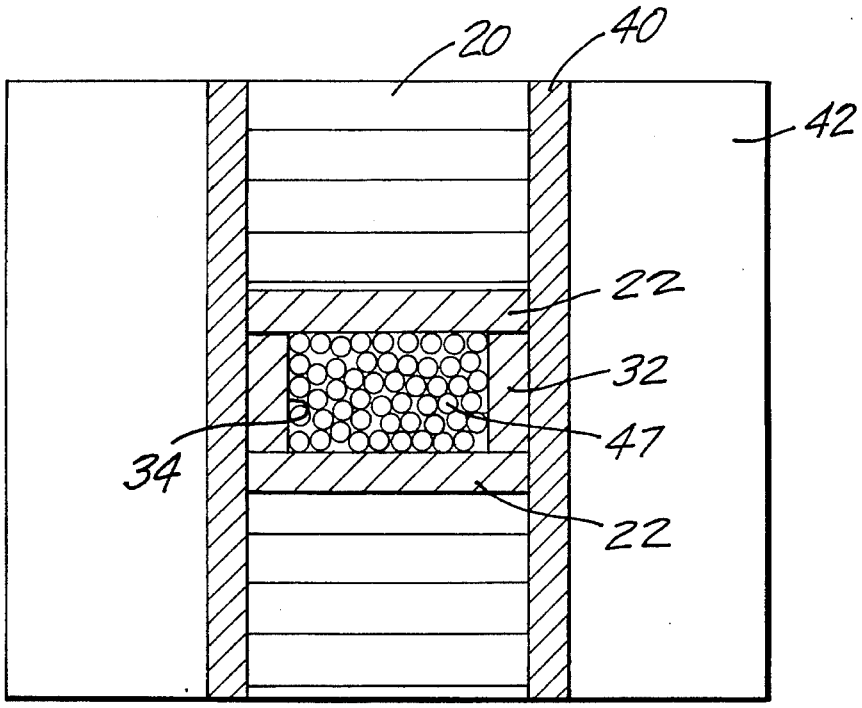
FIG. 6 is a sectional view taken along line 6—6 of FIG. 4.
Figure 9:
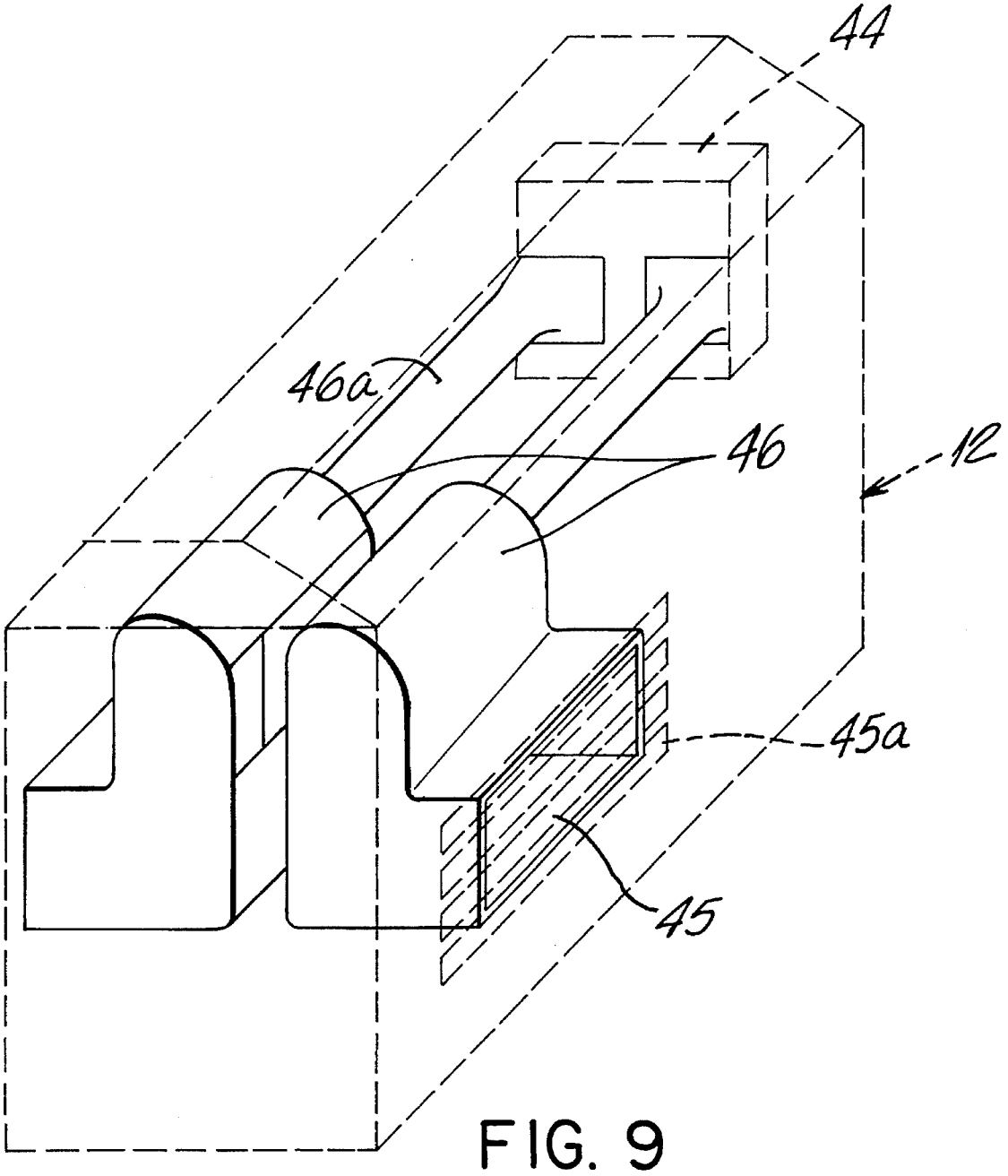
FIG. 9 is a schematic, isometric view of the blower assembly.
Figure 10:
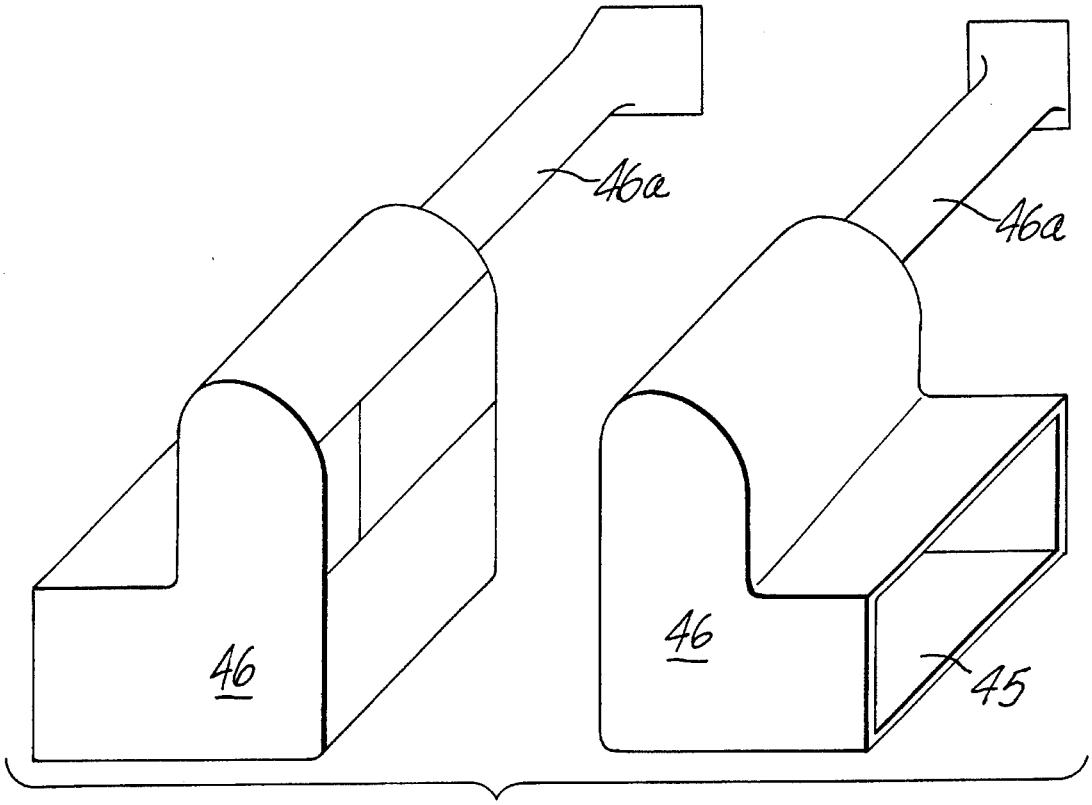
FIG. 10 is an enlarged, schematic view of portions of the blower assembly.
Figure 12B:
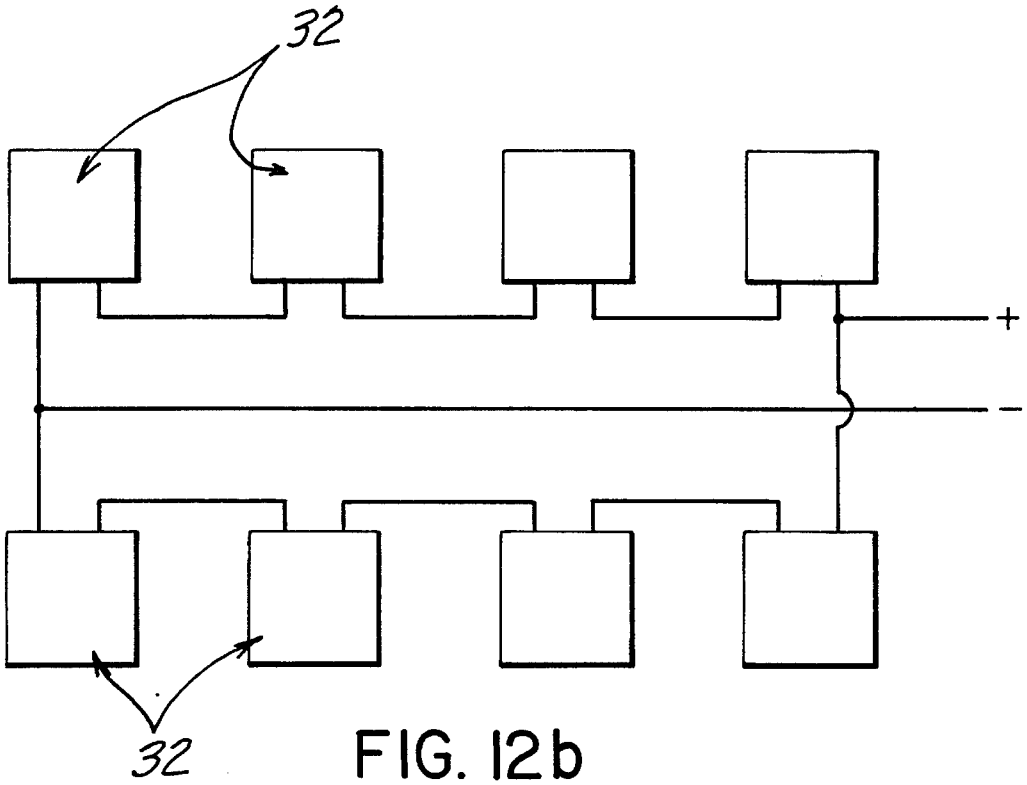
FIG. 12*b* is a schematic showing the series, parallel relationship among the various thermoelectric modules of the prevent invention.

In the illustrated embodiment of the thermoelectric cooling unit shown in FIGS. 5 and 12*b*, eight modules 32 are used, with four modules positioned on each side wall opposing each other across the cooling channel as shown in FIG. 5. A fin baseplate 40 is secured to the hot junction surface 35, and includes fin plates, 42 so as to form a heat sink for dissipating heat from the junction (FIGS. 5 and 6). A fan assembly 44 is positioned at the rear of the housing 12 and moves air from outside the housing, through an air duct opening, 45 over the fins 42, through air ducts 46 and air duct channels 46*a*, and out of the fan assembly 44 (FIGS. 9 and 10). The air duct opening 45 will include an air duct filter and cover 45*a* to prevent contaminants from entering the air stream inside the duct work.

As shown in FIG. 6, in one aspect of the invention metallic spheres 47 are inserted within the cooling channel 24. The spheres 47 engage each other as well as the cooling junction surface 34 of the thermoelectric module thus acting in conduction of heat from the beverage, which engages the spheres, through its spheres to the cold junction surface 34, into the hot junction surface 35, into the fins 42, to be expelled in the air drawn thereover. The spheres 47 are a size so that a plurality can be fitted into the cooling channel and can be made from stainless steel or other similar material.

In accordance with the present invention, a beverage faucet 48 is mounted on a side wall 16 of the housing and the beverage is dispensed therethrough as received from the channel through 48*a* positioned in the front mounting plate 26. Inverted beverage containers, i.e., bottles B, are mounted on top of the housing. In the present illustrated embodiment, the beverage containers are shown as beverage bottles containing a high viscosity alcoholic beverage.

Figure 7:
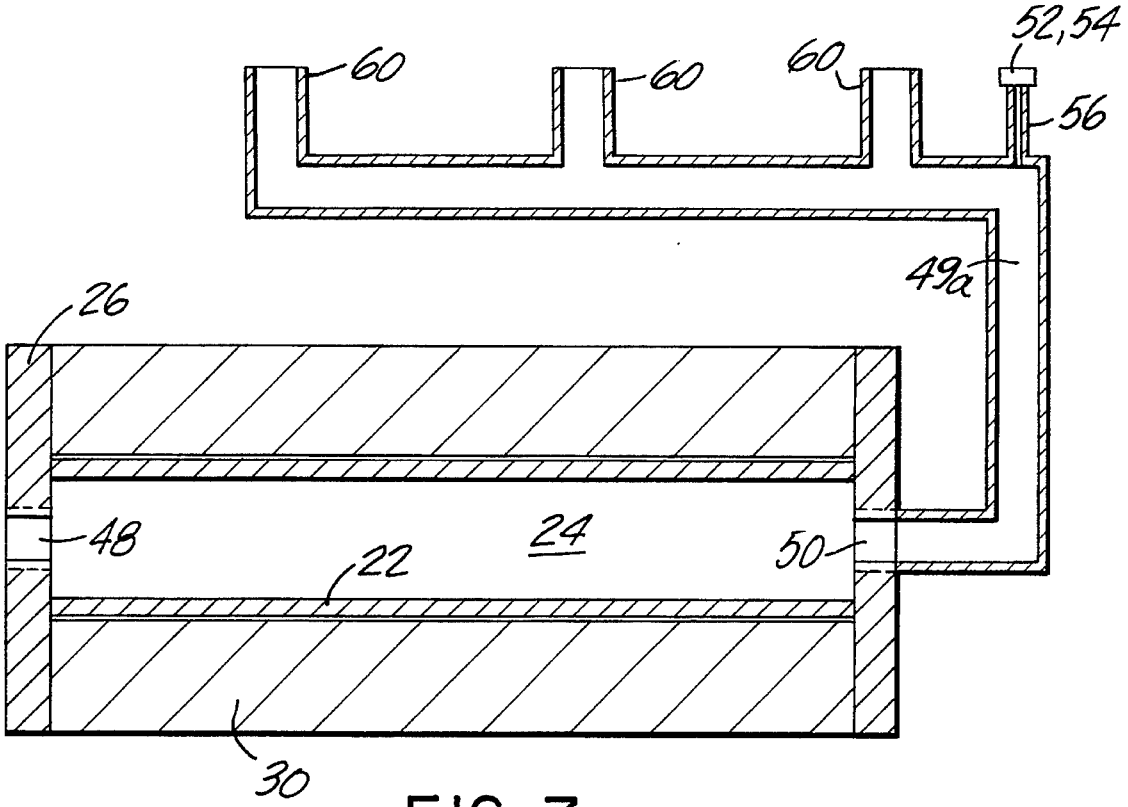
FIG. 7 is a sectional view of the cooling channel and manifold of the present invention.

A beverage receiving manifold 49 (FIGS. 2 and 7) extends along the top portion of the housing 12. A downwardly extending manifold section 49*a* is connected to the rear plate 27 to allow beverage into the cooling channel 24 by means of a beverage port 50 positioned in the rear plate 27 (FIG. 7). The beverage flows from inclined bottles mounted on the top surface of the housing, into the manifold 49 through the cooling channel by gravity flow, and into the beverage faucet 48. During beverage travel from the manifold through the cooling unit, the beverage is cooled to as low as 0° F.

Figure 3:
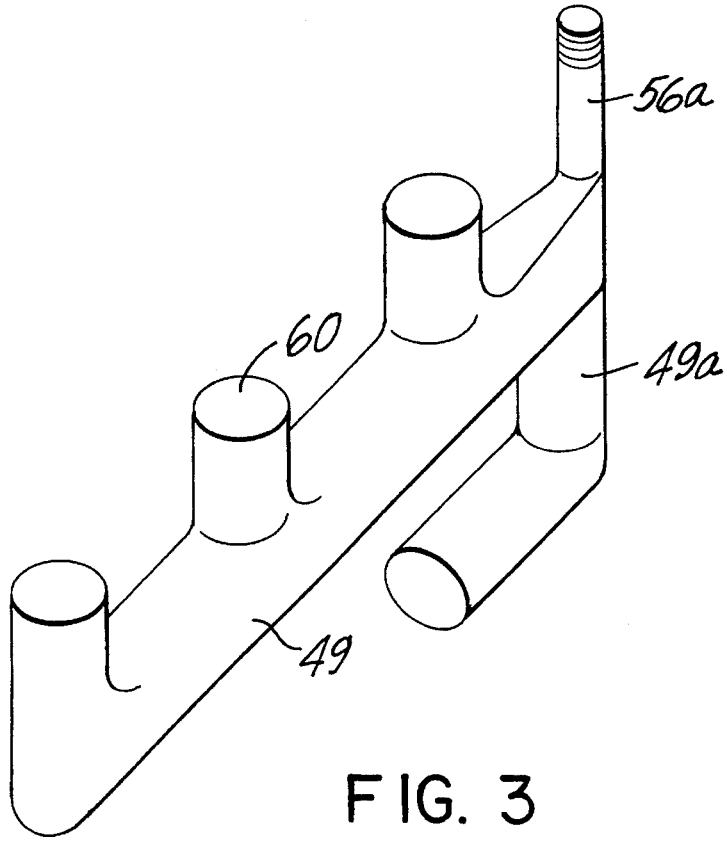
FIG. 3 is a schematic, isometric view of the manifold.
Figure 8:
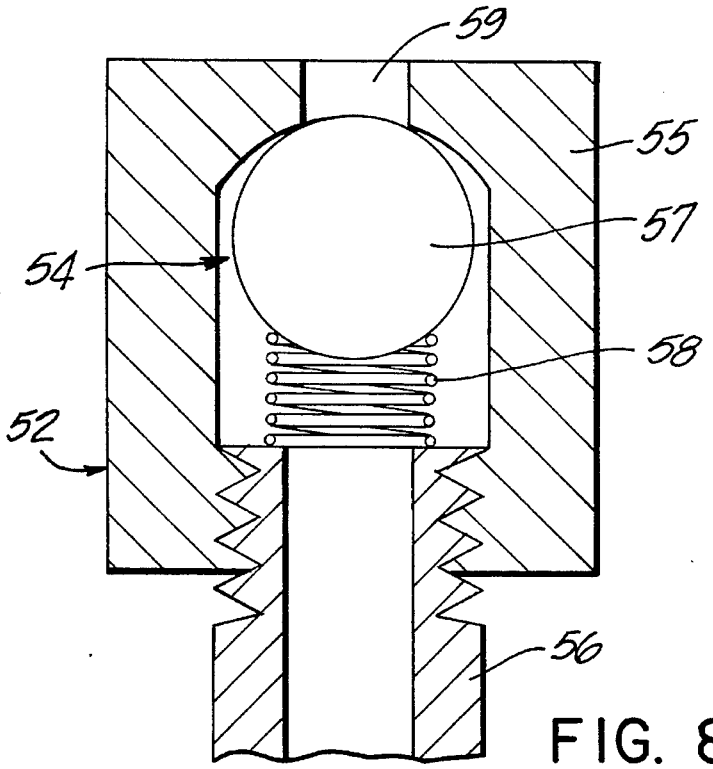
FIG. 8 is a sectional view of the air valve used in accordance with the present invention.

An air valve, indicated at 52, having a check valve assembly, indicated generally at 54, is connected into the manifold 49 and extend outward through the side 16 of the housing 12 (FIG. 3). The air valve 52 allows gravity flow of liqueur from the bottles into the manifold 49 and cooling chamber 24. The air valve 52 may become dirty, and it is easily removed and cleaned. As shown in FIG. 8, the air valve 52 is formed from a cap 55 threaded onto a pipe 56 having a threaded end 56*a* (FIG. 3). A ball 57 and spring 58 form the check valve. The ball 57 is biased by spring 58 into an opening 59 in the cap 55 to block air flow when pressure in the manifold is high. As beverage is dispensed and pressure decreases, atmospheric pressure forces the ball 57 against the spring 58.

Figure 11:
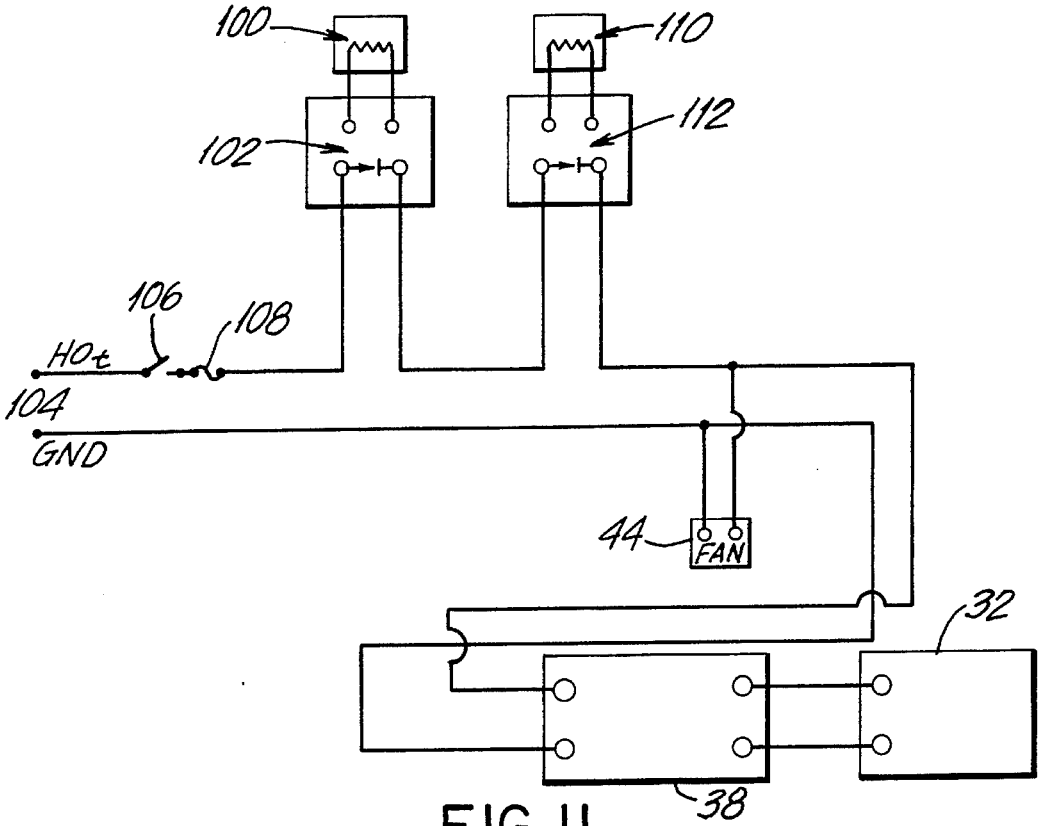
FIG. 11 is a schematic view of the power supply used with the thermoelectric cooling device of the present invention.

FIG. 11 shows a general schematic of the electrical system used for powering the thermoelectric modules 32 and the fan 44. A DC power supply 38 provides the requisite power for the thermoelectric modules 32. In addition, for maintaining temperature control and some control over the amount of cooling, a low temperature thermostat 100 is positioned in the cooling channel 24 among the spheres 47 and provides a temperature indication of beverage within the channel 24. The thermostat 100 is connected to a solid state relay 102, which is connected to a line voltage 104, having a switch 106 and fuse 108 therein. Additionally, a high temperature thermostat 110 is glued to a fin 42 and provides a temperature indication of the high heat transfer. A solid state relay 112 is connected into line voltage 104.

Referring now to FIGS. 13 and 14, there is illustrated in greater detail the mounting mechanism used for mounting the inverted bottles B onto the housing. As shown in FIG. 1, the beverage manifold 49 is mounted within the housing adjacent to top portion thereof. The manifold 49 connected to the rear plate 27 and delivers beverage through the cooling channel.

A bottle mount 60 (FIGS. 2, 3 and 14B) extends from the manifold 49 upward through the housing. Each bottle mount 60 is configured for receiving a stopper shaft of a bottle stopper, indicated generally at 64, which is inserted within a bottle B as shown in FIGS. 4A through 4C.

Figure 13A:
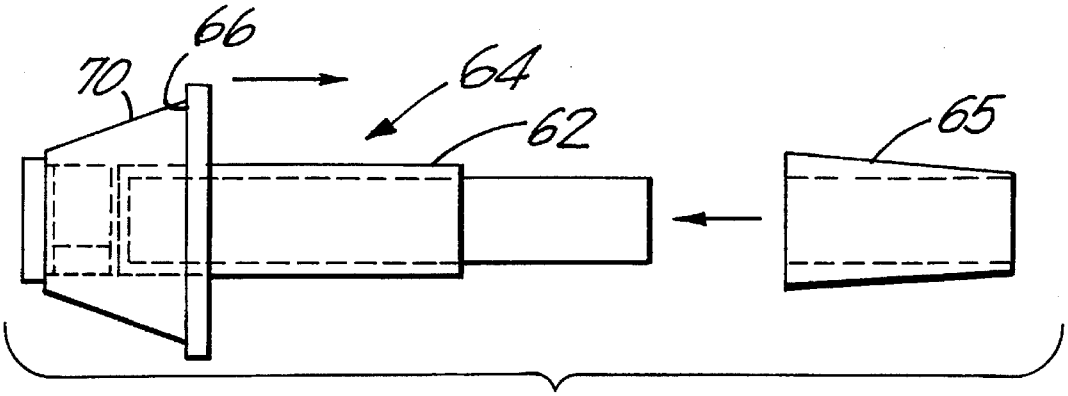
FIGS. 13A and 13B are plan views of the stopper shaft.
Figure 13B:
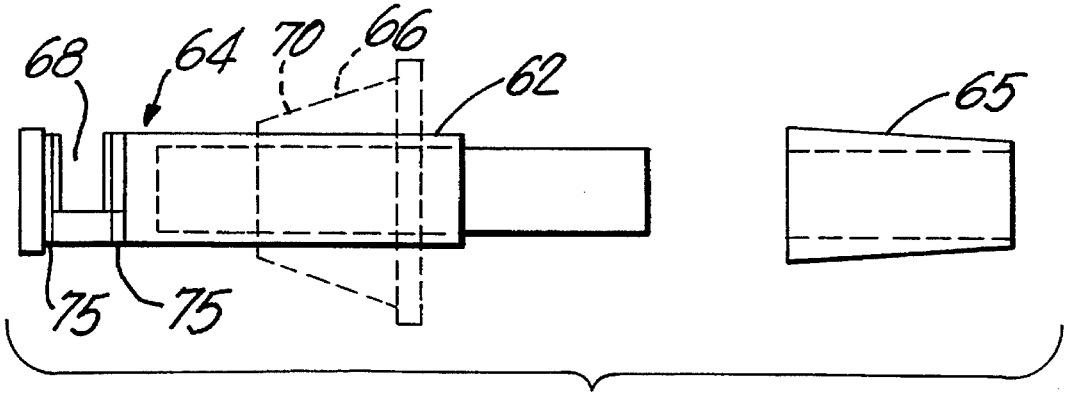

As shown in FIGS. 13A and 13B, the bottle stopper 64 is formed as a hollow shaft and includes a slidable collar 66 positioned on a medial portion of the stopper shaft 62. One end of the bottle stopper 64 is adapted for insertion into the neck of the bottle B and includes a tapered plug 65 which frictionally fits into the bottle opening. The other end has a side opening 68 (FIGS. 13B and 14C). The slidable collar 66 has a tapered portion 70 that engages a corresponding tapered portion 72 for the bottle mount. A collar 66 is moveable on the stopper shaft from a closed position where the collar 66 covers the side opening 68 to prevent beverage withdrawal to an open position where the collar uncovers the side opening 68 to allow beverage withdrawal when that is inserted within the bottle mount.

Figure 14A:
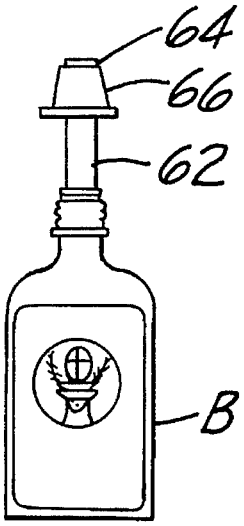
FIGS. 14A–14C shows the stopper shaft used with beverage bottles and supported on bottle mounts of the machine housing.
Figure 14B:
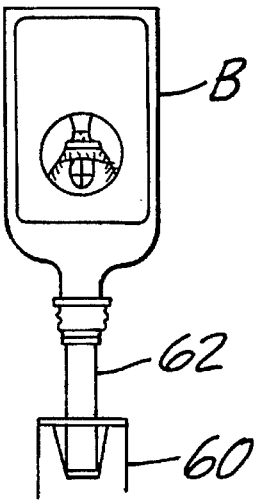
Figure 14C:
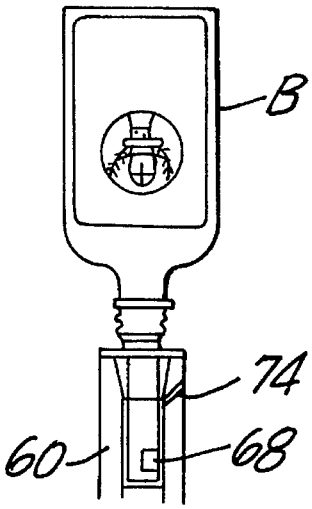

As shown in FIGS. 14A–14C, the collar 66 is moveable relative to the stopper shaft 62. When the stopper shaft 62 is inserted within a bottle mount 60 the bottle B is forced downward so that the side opening 68 becomes exposed. A vent hole 74 vents air to facilitate beverage withdrawal from the bottle B (FIG. 14C). An O-ring 75 is positioned above and below the side opening 68 and sealed in a closed position.

The use of the bottle mount 60 and beverage manifold 46 allows radial withdrawal of one bottle, without the necessity of replacing the other bottles. Also an adequate flow of beverage is maintained through the beverage faucet. To insure that the bottles B remain steady on top of the housing, a bottle support cage 78 also supports the bottles.

As shown in FIG. 1, the beverage faucet 48 includes a handle 80 which opens a valve in the outlet when the handle is pulled forward to allow beverage dispensing through the beverage faucet 48.

In operation, the bottle stopper 64 is initially placed into the bottle opening at the bottle neck so that stopper shaft 62 is forced into a fraction fit with the bottle opening. The collar 66 and the other end of the shaft are than inserted within the bottle mount on the housing. The bottle is pushed downward so that the shaft extends into the neck of the bottle mount. The vent hole 74 allows air entry so that beverage will dispense into the manifold.

The beverage flows into the thermoelectric cooling unit where it is cooled by the modules. The air valve/check valve combination 52, 54 allows air within the manifold 49 for beverage dispensing. An on/off switch 90 provides on-off operation to the modules 32 for cooling.

The machine in accordance with the present invention has numerous benefits. The use of the thermoelectric modules instead of a more conventional vapor compression refrigeration unit combination takes up less space and uses less energy. Also it is not as noisy as a compressor. This may ne advantageous during quiet times a restaurant and bars, such as early evening. The thermoelectric devices have higher reliability and precise temperature control at the smaller capacity volumes that are now being used.

It should be understood that the foregoing description of the invention is intended merely to be illustrative thereof, and that other embodiments, modifications, and equivalents may be apparent to the those skilled in the art without departing from its spirit.

That which is claimed is:

1. A machine for dispensing chilled beverage comprising a housing forming an enclosure and having an outer surface, means mounted within said housing for receiving a beverage, a beverage faucet mounted on the outer surface of said housing, a cooling channel extending from said beverage receiving means to said beverage faucet, said cooling channel having walls defining said channel, thermoelectric cooling means extending along a portion of said channel walls and having a cold junction surface proximal to the beverage which cools the beverage, and a hot junction surface spaced from the cold junction surface, and heat sink means extending from said hot junction surface for dissipating heat from said hot junction surface.

2. The machine according to claim 1 wherein said heat sink means comprises cooling fins operatively connected to said hot junction surface.

3. The machine according to claim 1 including means for blowing air over said heat sink means for cooling same.

4. The machine according to claim 1 including insulation covering at least a portion of said channel walls to maintain any beverage contained in the cooling channel at a chilled temperature.

5. The machine according to claim 1 including a front and rear plate, said cooling channel walls extending between said front and rear plates to form a cooling unit that may be readily removed from said housing.

6. The machine according to claim 1 including means positioned within said cooling channel and contacting said thermoelectric cooling means to aid in conducting heat from said beverage.

7. The machine according to claim 6 wherein said conduction means positioned in said channel comprises metallic spheres.

8. The machine according to claim 1 wherein said channel walls form a rectangular structure and said thermoelectric cooling means comprises a plurality of planar configured thermoelectric modules.

9. The machine according to claim 1 wherein said thermoelectric cooling means comprises semiconductor modules forming a thermocouple with hot and cold junctions.

10. A machine for dispensing chilled alcoholic beverage comprising a housing forming an enclosure and having side and top surfaces, said side and top surfaces being of such dimension to form a housing of a size to be placed on the countertop of a bar and the like, means mounted in said housing at a top portion thereof for receiving beverage, a beverage faucet mounted on the side surface of said housing, a cooling channel extending from said beverage receiving means to said beverage faucet, said cooling channel having walls defining said channel, thermoelectric cooling means extending along a portion of said walls and having a cold junction surface proximal to the beverage which cools the beverage, and a hot junction surface spaced from the cold junction surface, and bottle mounting means extending upward from said beverage receiving means positioned in the top portion of said enclosure and through said top surface of said housing for mounting a beverage container in an inclined position on said housing to supply beverage to said beverage receiving means and into said cooling channel.

11. The machine according to claim 10 wherein said beverage receiving means includes a beverage manifold positioned in the top portion of said housing, and said bottle mounting means comprises at least one bottle mount extending from said manifold means upward through said housing, each bottle mount being configured for receiving a stopper shaft inserted within a beverage container so that the beverage container may be invertibly mounted on the housing to supply beverage to said cooling tank.

12. The machine according to claim 11 including an air valve and check valve operatively connected to said manifold for permitting airflow therethrough, and including means removably mounting said air valve to allow removal and cleaning of same.

13. The machine according to claim 10 including heat sink means extending from said hot junction surface for dissipating heat from said hot junction surface.

14. The machine according to claim 13 wherein said heat sink means comprises cooling fins operatively connected to said hot junction surface.

15. The machine according to claim 14 including means for blowing air over said heat sink means for cooling same.

16. The machine according to claim 10 including insulation covering at least a portion of said channel walls to maintain any beverage contained in the cooling channel at a chilled temperature.

17. The machine according to claim 10 including a front and rear plate, said cooling channel walls extending between said front and rear plates to form a cooling unit that may be removed from said housing.

18. The machine according to claim 10 including means positioned within said cooling channel and contacting said thermoelectric cooling means to aid in conducting heat from said beverage.

19. The machine according to claim 18 wherein said conduction means positioned in said channel comprises metallic spheres.

20. The machine according to claim 10 wherein said channel walls form a rectangular structure and said thermoelectric means comprises a plurality of planar configured thermoelectric modules.

21. The machine according to claim 10 wherein said thermoelectric cooling means comprises semiconductor modules forming a thermocouple with hot and cold junctions.

* * * * *